US010829185B2

(12) United States Patent
Van Der Burg

(10) Patent No.: US 10,829,185 B2
(45) Date of Patent: Nov. 10, 2020

(54) HYDRAULIC MOORING CABLE HOLDING DEVICE, SYSTEM AND METHOD

(71) Applicant: ShoreTension Holding B.V., Rotterdam (NL)

(72) Inventor: Gerrit Van Der Burg, Barendrecht (NL)

(73) Assignee: ShoreTension Holding B.V., Rotterdam (NL)

( * ) Notice: Subject to any disclaimer, the term of this patent is extended or adjusted under 35 U.S.C. 154(b) by 0 days.

(21) Appl. No.: 16/330,801

(22) PCT Filed: Sep. 7, 2017

(86) PCT No.: PCT/NL2017/050588
§ 371 (c)(1),
(2) Date: Mar. 6, 2019

(87) PCT Pub. No.: WO2018/048303
PCT Pub. Date: Mar. 15, 2018

(65) Prior Publication Data

US 2019/0193816 A1 Jun. 27, 2019

(30) Foreign Application Priority Data

Sep. 7, 2016 (NL) ..... 2017431

(51) Int. Cl.
*B63B 21/20* (2006.01)
*B63B 21/00* (2006.01)

(52) U.S. Cl.
CPC ..... *B63B 21/20* (2013.01); *B63B 21/00* (2013.01); *B63B 2021/003* (2013.01);
(Continued)

(58) Field of Classification Search
CPC ... B63B 21/20; B63B 21/00; B63B 2021/003; B63B 2021/005; B63B 2021/008; B63B 2021/203
See application file for complete search history.

(56) References Cited

U.S. PATENT DOCUMENTS

RE15,256 E * 12/1921 St. John ..... B61L 3/04 246/182 R
3,865,066 A 2/1975 White et al.
(Continued)

FOREIGN PATENT DOCUMENTS

WO 2010110666 A2 9/2010

OTHER PUBLICATIONS

Nov. 13, 2017—International Search Report—PCT/NL2017/050588.

*Primary Examiner* — Stephen P Avila
(74) *Attorney, Agent, or Firm* — Banner & Witcoff, Ltd.

(57) ABSTRACT

A hydraulic mooring cable holding device provides a hydraulic cylinder-piston combination (20) for controlling the force on a mooring cable between one end of a ship and a mooring point. An overpressure protection part (26) with hydraulic liquid passing from the hydraulic cylinder (20) to a reservoir (260) when the pressure in the cylinder exceeds a threshold value, and returns the hydraulic liquid when the pressure has dropped. An auxiliary reservoir (24) with a steeper pressure response than the main reservoir (260) is connected in parallel with the main reservoir. The auxiliary reservoir may be connected to and/or disconnected from the cylinder under control of a sensor or a further mooring device at the other end of the ship, to reduce movement of the ship e.g. in swell. Furthermore, pressure from the auxiliary reservoir may be used to drive an electric generator.

12 Claims, 7 Drawing Sheets

(52) U.S. Cl.
CPC ... *B63B 2021/005* (2013.01); *B63B 2021/008* (2013.01); *B63B 2021/203* (2013.01)

(56) References Cited

U.S. PATENT DOCUMENTS

| | | | |
|---|---|---|---|
| 3,886,887 | A | 6/1975 | Cunningham et al. |
| 5,277,406 | A | 1/1994 | Knight |

* cited by examiner

HYDRAULIC MOORING CABLE HOLDING DEVICE, SYSTEM AND METHOD

CROSS-REFERENCE TO RELATED APPLICATIONS

This application is a U.S. National Stage application under 35 U.S.C. § 371 of International Application PCT/NL2017/050588 (published as WO 2018/048303 A1), filed Sep. 7, 2017, which claims the benefit of priority to Application NL 2017431, filed Sep. 7, 2016. Benefit of the filing date of each of these prior applications is hereby claimed. Each of these prior applications is hereby incorporated by reference in its entirety.

FIELD OF THE INVENTION

The invention relates to a hydraulic mooring cable holding device, a mooring system and to a method of holding a moored ship.

BACKGROUND

From WO2010/110666 a hydraulic mooring cable holding device is known that pays out a mooring cable when the force on the mooring cable exceeds a threshold and hauls the mooring cable back in only once the force has dropped back well below the threshold. The device comprises a hydraulic cylinder with a piston that is connected to the mooring cable so that hydraulic pressure builds up when the mooring cable comes under tension. A relief valve lets out hydraulic liquid from the cylinder to a reservoir when this pressure exceeds a threshold. A one way valve returns fluid from the reservoir to the cylinder when the tension on the mooring cable drops below a second threshold.

The hydraulic cylinder and the reservoir provide for operation in a pay-out phase and a hauling phase, when the pressure in the hydraulic cylinder rises to a high level and drops to a lower level respectively. Thus the ship is kept tautly moored, while protecting the mooring cable against breaking due to excessive forces, e.g. under influence of wind gusts. The device is highly failsafe because it requires no external power supply to keep the ship moored.

There are intermediate phases between the pay-out phase and a hauling phase, in which no hydraulic liquid flow occurs between the hydraulic cylinder and the main reservoir. In these phases the position of the piston substantially remains constant, whereas the force on the mooring cable may vary within a force range permitted by cable holding device.

When a ship is moored by two such cable holding devices connected to mooring cables on opposite ends of the ship, the ship may be kept tautly moored. Under static conditions both cable holding devices will be in their intermediate phase, keeping the mooring cables taut and keeping the ship at a fixed position.

As a result of variable external forces, for example due to swell from ocean waves or passing ships, the position of the ship may change. When the external force is sufficiently large it will cause one of the cable holding devices to pay out the mooring cable in order to avoid excessive force. The other cable holding device will haul in. Although this is necessary in the case of large external forces, it has been found that unnecessary movement of the ship may also occur. It would be desirable to avoid such unnecessary movements.

SUMMARY

Among others it is an object to provide for improved mooring.

A hydraulic mooring cable holding device is provided, comprising

- a hydraulic cylinder, a piston in said hydraulic cylinder, and connections to said hydraulic cylinder and said piston for connecting the device in a mooring cable connection between a ship and a mooring point,
- an overpressure protection part coupled to the hydraulic cylinder, the overpressure protection part comprising a main reservoir containing gas and hydraulic liquid, the overpressure protection part comprising an overpressure valve and a one way valve, coupled in parallel to each other between the hydraulic cylinder and the main reservoir, the overpressure valve configured to pass hydraulic liquid from the hydraulic cylinder to the main reservoir when a difference between a first pressure in the cylinder and a second pressure in the main reservoir exceeds a first threshold value, the one way valve configured to pass hydraulic liquid from the main reservoir to the hydraulic cylinder when the difference drops below a second threshold value, lower than the first threshold value.

As in the prior art cable holding device, the hydraulic cylinder and the main reservoir provide for operation in a pay-out phase and a hauling phase, with intermediate phases.

Furthermore, the hydraulic mooring cable comprises an auxiliary reservoir coupled to the hydraulic cylinder, the auxiliary reservoir containing gas and hydraulic liquid, the main reservoir having a first pressure-volume change characteristic that differs from second a pressure-volume change characteristic of the auxiliary reservoir, in the sense that the pressure in main reservoir changes less than the pressure in auxiliary reservoir for equal exchanges of volume of the hydraulic liquid from the hydraulic cylinder.

Hydraulic pressure communication between the hydraulic cylinder and the auxiliary reservoir makes it possible to add adjustments to the force on the mooring cable in the intermediate phase of operation.

Although the invention is not limited to a specific theory of operation, a theory of the operation involving the hydraulic cylinder and the main reservoir only indicates that dynamic conditions and elastic forces from the mooring cables can cause multiple cable holding devices that are connected to mooring cables from the same ship to operate in uncoordinated fashion when they have no auxiliary reservoir. The cable holding devices may operate out of phase in opposite directions, e.g. when one cable holding device is in the hauling phase when another is still in the intermediate phase. This may cause one cable holding device to transfer an unnecessarily large amount of hydraulic liquid to or from its main reservoir, which in turn leads to a subsequent unnecessary response from the other cable holding device.

Transfer of hydraulic liquid between the hydraulic cylinder and the auxiliary reservoir can be used to avoid this. In one embodiment the auxiliary reservoir may provide for changes in the volume of hydraulic liquid in the hydraulic liquid in the hydraulic cylinder to pay-out and/or haul-in the mooring cable in proportion to hydraulic pressure changes during the intermediate phase, throughout the entire pressure range allowed by the overpressure protection, or only above a threshold. This provides for a more stable force on the mooring cables in a stable position of the ship.

In an embodiment, the cable holding device comprises a control unit that controls the timing of activation of pressure communication between the auxiliary reservoir and the hydraulic cylinder dependent on sensor input. The pressure communication may be selectively activated in the cable holding device when another cable holding device that acts on the same ship hauls in in an opposite direction for example. The control unit may be configured to receive and execute an external command or use external sensor data to activate the pressure communication. The cable holding device may comprise a sensor to detect piston position and/or movement, a liquid volume or pressure for use to generate and transmit such a command or external sensor data to another cable holding device for this purpose.

Hydraulic pressure communication between the hydraulic cylinder and the auxiliary reservoir makes it possible to add adjustments to the force on the mooring cable in the intermediate phase of operation It may be noted that, instead of activating an de-activating pressure communication between the auxiliary reservoir and the hydraulic cylinder, pressure communication between the main reservoir and the hydraulic cylinder may be activated an de-activated. In an embodiment wherein the different pressure-volume response characteristics are not used, the auxiliary reservoir could be omitted in this case. However it may be desirable to use the pressure communication with the auxiliary reservoir for better fail-safe operation and/or for a faster response even in circumstances wherein the different pressure-volume response characteristics per se are not necessary.

In an embodiment the cable holding device may comprise a fluid flow driven electrical power generator connected to generate electrical power from hydraulic liquid flow based on a hydraulic pressure difference between the auxiliary reservoir and the hydraulic cylinder.

Furthermore a method of holding a moored ship is provided, using a first and second cable holding device, each comprising a hydraulic cylinder and a piston in the hydraulic cylinder, a main reservoir and an auxiliary reservoir containing hydraulic liquid and gas.

BRIEF DESCRIPTION OF THE DRAWING

These and other object and advantageous aspects will become apparent from a description of exemplary embodiments, using the following figures.

DETAILED DESCRIPTION OF EXEMPLARY EMBODIMENTS

Figure 1:
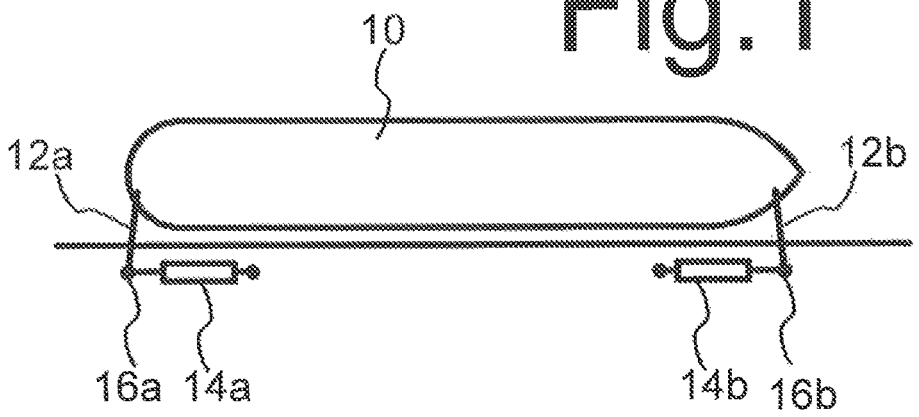
FIG. 1 shows a plan view of a ship moored along a quayside

FIG. 1 shows a schematic plan view of a ship 10 moored along the quayside, using a first and second mooring cable 12*a,b* that run from the quayside to the ship. The ship may lie against shore-side fenders (not shown) extending from the quayside. On the quayside mooring a first and second cable holding device 14*a,b* are provided, coupled to the first and second mooring cable 12*a,b* respectively. Each mooring cable holding device 14*a,b* is coupled on one side to a mooring point such as a fixed bollard, and on the other side to mooring cable 12*a,b*. Alternatively, the mooring points could other structures on the quayside to which one side of the cable holding device 14*a,b* could be fixed. Instead of a fixed quay the mooring points may be provided on a floating structure to moor the ship with respect to that floating structure.

In the illustrated embodiment the mooring cable 12*a,b* runs from the cable holding device 14*a,b* to the ship 10 via a further bollard 16*a,b*. As shown, mooring cables 12*a,b* run from the ship to the mooring cable holding device 14*a,b* nearly perpendicularly to the shoreline direction along the quayside (e.g. with less than a forty five degree deviation from the perpendicular direction). In addition or alternatively, spring mooring cables (not shown) at greater angles to the perpendicular direction may be used. It should be appreciated that the use of mooring cables 12*a,b* that run nearly perpendicularly to the shoreline on one hand minimizes quay space needed for ship 10, but on the other hand could increase the risk of broken cables because of high tension will arise in mooring cables 12*a,b* as a result of upward or lateral movement of ship 10 due to swell or wind. In such a mooring configuration cable holding device 14*a,b* prevents high tension on mooring cables 12*a,b*, but it may also prevents high tension in a spring configuration.

Figure 2:
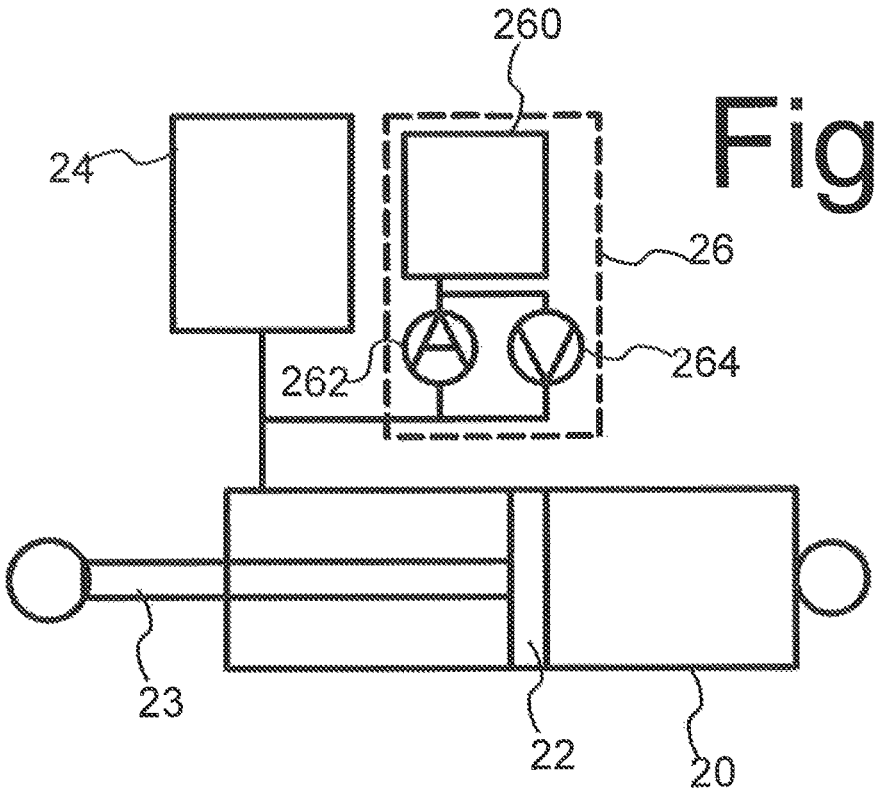
FIG. 2 schematically shows a cable holding device

FIG. 2 schematically shows a cable holding device. The device comprises a main cylinder 20, a main piston 22 in main cylinder 20 and a piston rod extending from main piston 22. Main cylinder 20 and piston rod 23 have respective connections on opposite ends of main cylinder 20. A first end is for attaching a cable that runs to the ship (not shown) and a second end is for connection to a mooring point, for example via a cable to a bollard (not shown) on the quayside. Cable connection eyes may be provided in connection with main cylinder 20 and piston rod 23 for this purpose for example. Main cylinder 20 is filled with hydraulic liquid (e.g. oil) on at least the side of main piston 22 in the direction of piston rod 23.

At a first end of main cylinder 20 on the side at which the cable attachment connection of main piston 22 is located, the interior of main cylinder 20 is coupled to a hydraulic circuit, which comprises an overpressure protection part 26 comprising a main reservoir 260 for hydraulic liquid and an auxiliary buffer 24, comprising an auxiliary reservoir for hydraulic liquid.

Overpressure protection part 26 is configured to take up hydraulic liquid from the hydraulic cylinder and return hydraulic liquid to the hydraulic cylinder when a difference between a pressure of the hydraulic liquid in the hydraulic cylinder and a pressure in the main reservoir lies above a first threshold and below a second threshold respectively, the second threshold being smaller than the first threshold. In this way, overpressure protection part 26 allows the cable holding device to give slack when the force on the cable exceeds a threshold corresponding to the first threshold and hauls the cable when the force drops off.

Overpressure protection part 26 comprises a main reservoir 260, an overpressure valve 262 and a one way valve 264. Overpressure valve 262 may be realized by means of a spring loaded valve, so that hydraulic liquid flow arises when hydraulic liquid pressure over the valve overcomes the spring force, but any other type of overpressure valve 262 may be used. Main reservoir 260 contains gas (e.g. nitrogen or air) and a variable amount of hydraulic liquid (preferably a hydraulic liquid like oil). Main reservoir 260 is a closed reservoir in the sense that it normally keeps gas and hydraulic liquid in main reservoir 260 under pressure except for the effects of overpressure valve 262 and a one way valve 264.

Main reservoir 260 has a predetermined pressure characteristic that defines the pressure in main reservoir 260 as a function of the volume of hydraulic liquid in main reservoir 260 and temperature. The pressure characteristic is a result of gas pressure variation. Preferably, the volume of main reservoir 260 and the amount of gas in it are so large that the pressure does not vary significantly with practical changes of the volume of hydraulic liquid in main reservoir 260. In an embodiment, overpressure protection part 26 may comprise a freely movable separator (e.g. piston) between the gas and the hydraulic liquid, but this may not be needed, e.g. when is ensured that the space occupied by the gas remains above the connection to one way valve 264.

The first end of main cylinder 20 is coupled to a liquid containing part of main reservoir 260 via overpressure valve 262, which is configured to open in order to allow hydraulic liquid to flow when the pressure on the side in the main cylinder 20 at the first end of main cylinder 20 exceeds the pressure in main reservoir 260 by a predetermined amount. When that happens, hydraulic liquid flows from main cylinder 20 to main reservoir 260, thereby allowing further movement of main piston 22 at substantially constant force. In this way, overpressure valve 262 serves to cause the device to give slack on the mooring cable (not shown) when the force transmitted by the cable exceeds a threshold.

The main reservoir 260 is further coupled to the first end of main cylinder 20 via one way valve 264, which is directed to open in order to allow hydraulic liquid to flow when the difference between the pressure on the side of main reservoir 260 and the pressure in the main cylinder 20 at the first end of main cylinder 20 exceeds a threshold (e.g. when the pressure in main cylinder 20 has become slightly lower that that in main reservoir 260). In this case hydraulic liquid returns to main cylinder 20 via one way valve 264. In this way, one way valve 264 serves to cause the device to haul in the mooring cable (not shown) when the force on the cable has chopped off to substantially zero.

For example, one way valve 264 may be configured to open when the pressure in main reservoir 260 exceeds that at the first end in the main cylinder 20. However, a different threshold may used, which is lower than that of overpressure valve 262. Thus, overpressure valve 262 and one way valve 264 give rise to a form of hysteresis: the pressure in main cylinder 20 needs to drop by a predetermined non-zero amount before hydraulic liquid passed by overpressure valve 262 is returned via one way valve 264.

In addition, the cable holding device may comprise a priming unit for setting up pressure at a second end of main cylinder 20 at which the cable attachment connection of main cylinder 20 is located. The priming unit may comprise a pump, a valve and an auxiliary reservoir of hydraulic liquid, the pump and the valve being coupled in parallel between the auxiliary reservoir and the main cylinder. The auxiliary reservoir may be an open reservoir in the sense that it need not maintain pressure, or maintains only a low pressure: it may have a relief valve to the outside.

In operation the priming unit may be used temporarily to set the position of main piston 22 when the ship 10 is moored. Before mooring main piston may first be driven to a maximum position, by pumping hydraulic liquid from the auxiliary reservoir into main cylinder 20 on the side of main piston 22 opposite to that where proportional pressure regulating part and overpressure protection part are connected. At this stage the valve of the priming unit is kept closed. When a cable has been fastened between a ship along the quay and the mooring device, the valve may be opened to allow hydraulic liquid to flow back to the auxiliary reservoir, with the effect that hydraulic pressure from main reservoir 260 will drive back piston 22, taking up slack from main reservoir 260 equals the pressure due to force on the cable. The valve may be left open during further use.

Figure 2A:
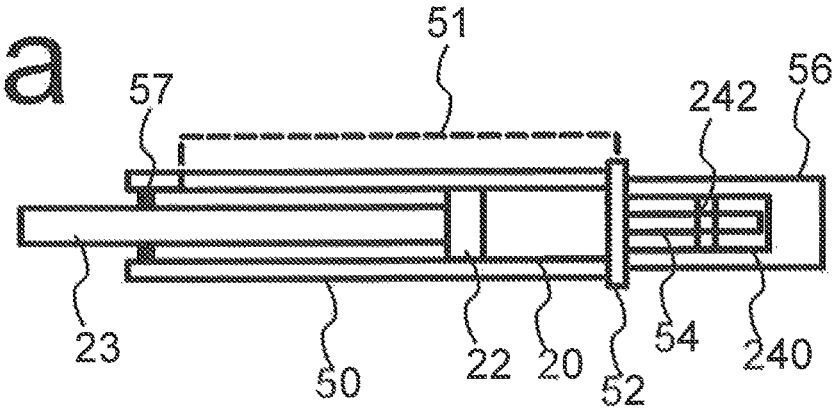
FIG. 2*a* shows an embodiment of the construction of the cable holding device

FIG. 2*a* shows an embodiment of the construction of the cable holding device. The cable holding device comprises main cylinder 20, an outer cylinder 50, a conduit 51 (shown symbolically by a dashed line) and a valve manifold 52 in the form of a disk. Main cylinder 20 is placed within an outer cylinder 50, preferably concentrically with outer cylinder 50, leaving a space between main cylinder 20 and outer cylinder 50. The space between main cylinder 20 and outer cylinder 50 serves as main reservoir 260. At one axial end of outer cylinder 50 and main cylinder 20 are attached to a first disk face of valve manifold 52. The disk shape of valve manifold 52 has a diameter that is at least as large as that of outer cylinder 50. Although conduit 51 is shown as a conduit outside the main cylinder, it may in fact run through a space within outer cylinder 50, e.g. between outer cylinder 50 and main cylinder 20.

An axial end of an auxiliary reservoir 240 is attached to a second disk face of valve manifold 52, opposite to the first face. Auxiliary reservoir 240 acts as an auxiliary cylinder of the auxiliary buffer. The central axes of main cylinder 20 and the auxiliary reservoir may be aligned with each other. Furthermore, the device comprises a pipe 54 extending from the second face of valve manifold 52 into auxiliary reservoir 240. Auxiliary piston 242 may be mounted slideably around pipe 54. Pipe 54 has one or more openings near the end of auxiliary reservoir 240 that allow for fluid communication between the interior of pipe 54 and a first part of auxiliary reservoir 240 on the side of auxiliary piston 242 away from valve manifold 52. There is no direct fluid communication between the interior of pipe 54 and a second part of auxiliary reservoir 240 outside the pipe between auxiliary piston 242 and valve manifold 52. This second part contains gas. Although an embodiment has been shown with pipe 54, it should be appreciated that alternatively a hollow pipe may be omitted, the roles of the spaces in auxiliary reservoir 240 on different sides of auxiliary piston being interchanged in this case.

Main piston 22 is located within main cylinder 20. Piston rod 23 extends from main piston 22 to outside main cylinder 20. The diameter of piston rod 23 is smaller than the inner diameter of main cylinder 20, leaving space for hydraulic liquid. A sealing ring 57 is provided between piston rod 23 and main cylinder 20, preferably near or at the end of main cylinder 20. One end of conduit 51 is in fluid connection with the interior of main cylinder 20 between main piston 22 and sealing ring 57. Conduit is connected to main cylinder 20 near the end of main cylinder 20. The other end of conduit 51 is connected to valve manifold 52. Conduit 51 provides for hydraulic liquid communication between the interior of main cylinder 20 and valve manifold 52. In an embodiment, conduit 51 is provided in the space between main cylinder 20 and outer cylinder 50.

Valve manifold 52 contains a number of connection channels within its disk shaped form. A first connection channel in valve manifold 52 runs from conduit 51 to the interior of pipe 54 and through that pipe 54 to the part of auxiliary reservoir 240 on the side of auxiliary piston 242 away from valve manifold 52. In the embodiment without hollow pipe the first connection channel may be in communication with the space between valve manifold 52 and auxiliary piston 242.

A second connection channel in valve manifold 52 runs from conduit 51 to the space between main cylinder 20 and outer cylinder 50 via the overpressure valve (not shown). A third connection channel in valve manifold 52, which contains the one way valve (not shown), bridges at least the part of the second connection channel that contains the overpressure valve. Furthermore, valve manifold 52 may comprise one or more pressure indicators, configured to indicate pressure in the main reservoir, pressure in main cylinder, pressure from conduit 51 and/or pressure from auxiliary reservoir 240.

In an embodiment one or more fourth connection channels may be provided in valve manifold 52, running from outside auxiliary reservoir 240 to the interior space of main cylinder 20 between valve manifold 52 and main piston 22. In the embodiment wherein an auxiliary reservoir is used, an auxiliary outer cylinder 56 may be provided, auxiliary reservoir 240 being placed within auxiliary outer cylinder 56, leaving a space between auxiliary reservoir 240 and outer auxiliary reservoir 56. The space may be used as the auxiliary reservoir for hydraulic liquid. One end of auxiliary reservoir 240 and outer cylinder 56 may be attached to the second face of the disk shape of valve manifold 52. In this embodiment, the one or more fourth channels of valve manifold 52 may run between the space the between auxiliary reservoir 240 and auxiliary outer cylinder 56 on one hand and the interior space of main cylinder 20 on the other hand. The valve of the priming unit may be included in valve manifold 52, with a control organ for controlling this valve outside valve manifold 52. If the priming unit contains a pump, it may be located in the space between auxiliary reservoir 240 and auxiliary outer cylinder 56, or on the outside.

In an embodiment a position sensing arrangement may be provided for determining the position of main piston 22. The position sensing arrangement may comprise one or more markers, e.g. magnetic markers, on piston rod and a position sensor on or outside main cylinder 20 to sense a marker when it moves past the sensor.

In an embodiment the cable holding device comprises a wireless transmitter and/or receiver. A (programmed) logic circuit or a microcomputer may be provided coupled to the wireless transmitter and the position sensor and/or the pressure indicators. A microcomputer may have program with instructions to receive data from the position sensor and/or the pressure indicators and to cause the wireless transmitter to transmit information derived from this data, or to evaluate the data to detect whether the data meets a predetermined condition for generating a signal and to cause the wireless transmitter to transmit a message if the condition is met. The condition may be that the data indicates that the main piston has remained in an extreme range of positions for at least a predetermined duration of time. The transmitted messages may be received for display in a control room for example.

In an embodiment, auxiliary reservoir 240, auxiliary outer cylinder 56 and pipe 54 may be exchangeable. In this embodiment, different sets of auxiliary reservoir 240, auxiliary outer cylinder 56 and pipe 54 may provided, each set providing for an auxiliary reservoir 240 of different length. In this case cylinders from a selected set may be mounted on valve manifold 52, the set being selected dependent on expected swell conditions. Different sets, with different length may be used in different ports, or on different quays in the same port. Auxiliary reservoir 240, auxiliary outer cylinder 56 and pipe 54 may have flanges with bolt holes to bolt them on valve manifold 52.

Force Limitation Operation

In operation, cable holding device 14*a,b* serves to limit the motion of ship 10 while avoiding excessive tension on a mooring cable 12*a,b*. This may occur during a force cycle such as during a wind squall or when ship 10 is lifted and lowered by swell. Typical swell can have an amplitude in an order of magnitude of one meter and a wavelength in the order of magnitude in the order of a hundred meters, which may lead to wave phase differences in the swell at the bow and stern of a ship.

Figure 3A:
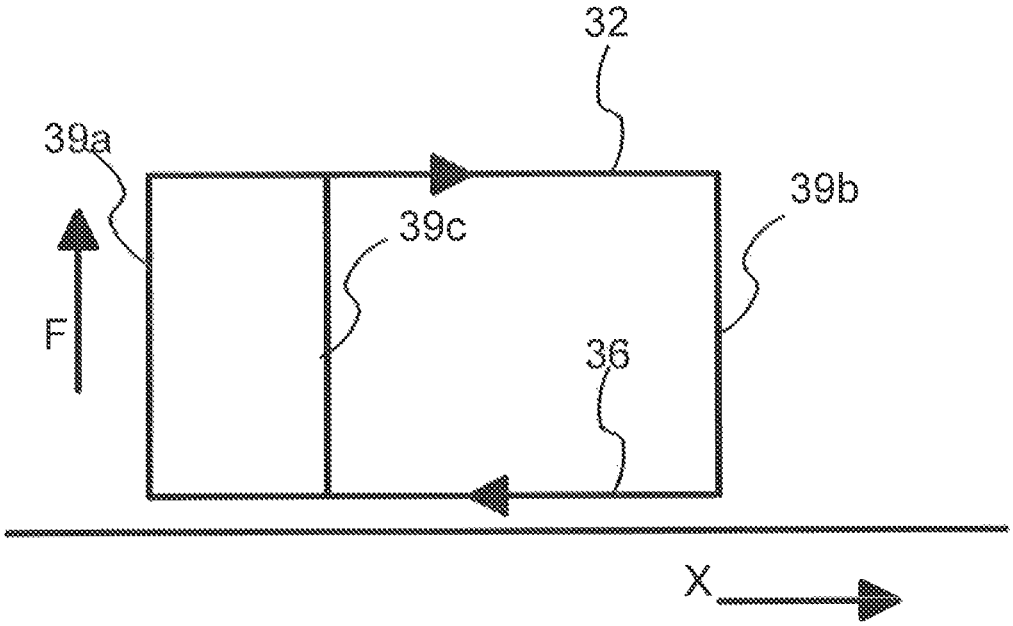
FIG. 3*a-f* show graphs of force as a function of piston position

FIG. 3*a* shows a graph of force F and stroke X (position) of the main piston 22 during a force cycle for a device wherein only overpressure protection part 26 is present, but not auxiliary buffer 24. When an external force, e.g. due to wind or water movement, is exerted on the ship, this creates a force on main piston 22.

Initially the hydraulic liquid resists this force, which corresponds to the vertical increase 39*a*. Although the force on the cable holding device rises vertically, it may be noted that the force on the ship rises more gradually, due to elasticity of the mooring cables.

When the force reaches a predetermined threshold, overpressure valve 262 opens with the result that main piston 22 moves on at substantially constant reaction force, which results in piston movement at a first force level 32. This may continue until the force drops off or until the piston movement reaches a stop defined e.g. by an inward flange of in main cylinder 20. Although a constant first force level 32 is shown, it should be realized that in fact the force may increase slightly with increase of the pressure of the gas in main reservoir 260 due to compression, but this effect can be kept below a desired size by using a sufficiently large main reservoir 260.

When, later, the force exerted on the mooring cable drops off, overpressure valve 262 closes. This results in a vertical drop 39*c* of the force at constant position. If the force drops to a level corresponding to the pressure associated with opening one way valve 264 (e.g. zero pressure), one way valve 264 allows auxiliary piston 244 to move back at substantially constant (e.g. zero) reaction force. This results in piston movement at a second force level 36, which may in fact vary slightly like first force level 32.

When the force rises from the second force level, the hydraulic liquid will again resist the force. This may occur at the original position (as indicated by vertical rise 39*a*), or elsewhere, e.g. as indicated by vertical line 39*c*, wherever the force rises again.

The cable holding device moves through a cycle, in which different phases may be distinguished, the upper horizontal line 32 of FIG. 3*a* corresponds to a pay-out phase, and the lower horizontal line 36 corresponds to a hauling phase, with intermediate phases in between, wherein the force may increase or decrease. As will be appreciated, the force and position graph of FIG. 3 shows that the force-position relation depends on the previous movement history, i.e. it shows hysteresis. As a function of time the combination of force-position may return to a previous value through a loop if the force-position graph of FIG. 3*a*. The area of this loop corresponds to energy generated by movement of the ship and absorbed by the cable holding device. The absorbed energy may heat the hydraulic liquid, which in turn releases the heat to the ambient via the surface of the cable holding device.

It may be noted that different ways of imposing force limitation do not necessarily involve hysteresis. For example, if the more uniform solution of a further proportional pressure regulating part instead of overpressure protection part 26 such a further proportional pressure part would limit the rate of the force increase with displacement without hysteresis.

When two or more cable holding device 14*a,b* are connected to the same ship, the force exerted by each device affects the force exerted on the other.

Figure 3B:
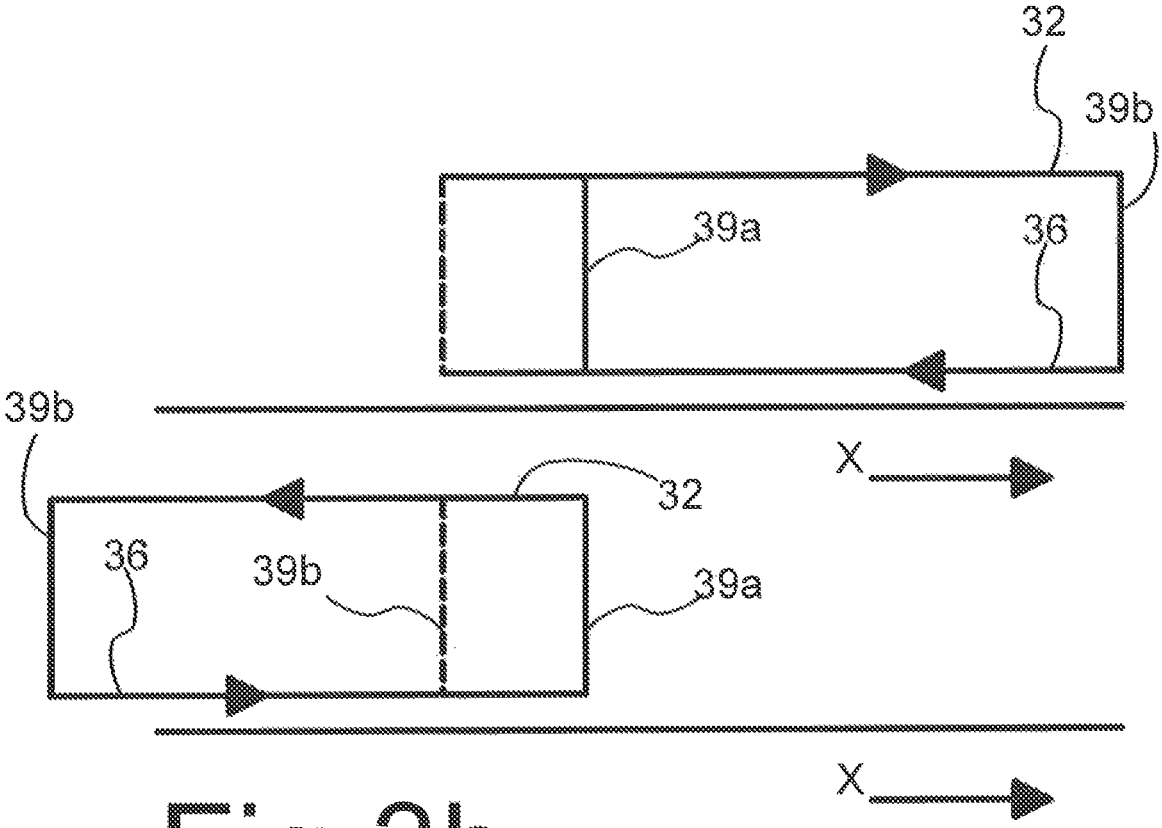

FIG. 3*b* shows a graph of forces as a function of position of a ship, where the forces are forces exerted by two cable holding devices, when the two cable holding devices act in opposite direction of the same ship. In this case the plotted forces act in opposite directions. The position of the ship may position along the quay in the case of movement of the ship along the quay, or rotation angle if the ship rotates slightly around a vertical axis in the plane of the quayside. The graphs of FIG. 3*b* are shown on a common position scale (a compressed force scale compared to FIG. 3).

Overall, when the forces exerted by the cable holding devices act in opposite directions, their difference equals the sum of forces exerted on the ship externally from the cable holding devices, which will be referred to as the external force. At rest, the external force is zero, and the forces exerted by the cable holding devices will be equal. In the example of FIG. 3*b*, this occurs in principle at the position of the ship wherein both cable holding devices are in their intermediate phase, i.e. where the vertical rises 39*a* occur in the force position diagram. Because the vertical rises are vertical, the actual force exerted by the cable holding devices is theoretically indeterminate between its minimum and maximum value: the force in both devices could counteract at an arbitrary force level. In practice, this is not so, because the forces between the cable holding devices are transmitted indirectly via the ship. The forces on the ship also depend on elastic behavior of the mooring cables and stick slip forces arising between (fenders on) the quayside and the ship, which have the effect of producing a stable force level.

When temporary external forces arise, e.g. due to swell or wind, the ship's position may change. When the external force overcomes stick slip the force on one of the cable holding device may reach the first level 32, causing it to enter the pay out phase, while the other cable holding device will enter the hauling phase. As a result, the ship will move. When the external force has dropped off, the ship may remain at a shifted position, with new positions vertical force rises 39*a*. In effect, this is because some of the hydraulic liquid from the main cylinder will remain in the main reservoir 260 of overpressure protection part 26.

This may have an advantageous effect in that the ship automatically assumes a position wherein both cable holding devices act with proportional force to keep the ship in a stable position, even if the amounts of hydraulic liquids in the main cylinders of the cable holding devices have not been primed according to the initial position. But in practice, disturbance by an external force may also lead to unnecessary repeated changes of the ship's stable position, which is undesirable. For example, when a time lag occurs in the transmission of forces from the cable holding devices, e.g. due to elastic effects in the mooring cables, both cable holding devices may not be in opposite hauling/pay out phases: while has entered its hauling phase, the other still be in its intermediate phase, or even in its previous hauling phase. This may result in a change of the stable position.

Proportional Embodiments of the Auxiliary Buffer

Figure 4:
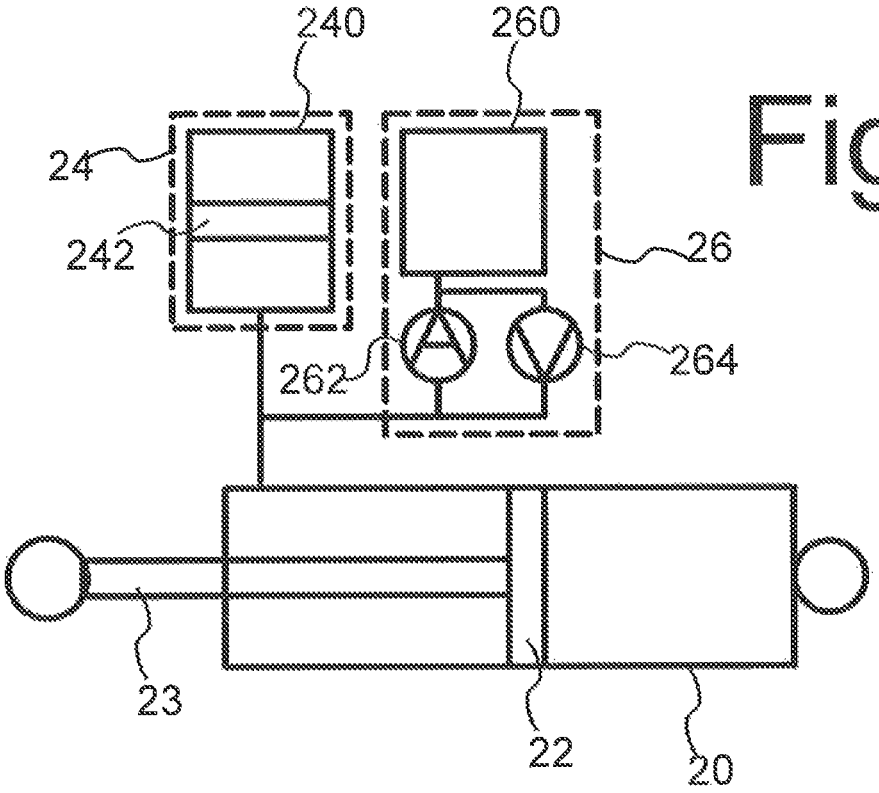
FIGS. 4-8 shows an embodiments of a cable holding device

FIG. 4 shows a first embodiment of a cable holding device, wherein auxiliary buffer 24 provides for a proportional force during operation of the cable holding device in the intermediate phase. Thus, the position of the piston may change while the cable holding device is still in the intermediate phase, in proportion to force changes (as used herein, "in proportion" means that the position varies with variation of the force, but is not limited to a linear force-position relation).

In the system formed by a moored ship and a plurality of cable holding devices coupling the ship to the quayside, and in the operation of this system, this has the effect that the influence of the interaction between the cable holding devices on changes of the stable position of the ship is reduced.

In the embodiment of FIG. 4, auxiliary buffer 24 comprises an auxiliary reservoir 240, in which a movable auxiliary piston 242 is provided. Auxiliary reservoir 240 contains gas and hydraulic liquid. Auxiliary piston 242 separates the gas and hydraulic liquid. A first part of auxiliary reservoir 240 on a first side of auxiliary piston 242 contains the hydraulic liquid and is coupled to the first end of main cylinder 20. Hence the hydraulic liquid is in fluid communication with main cylinder 20.

A second part of auxiliary reservoir 240 on a second side of auxiliary piston 242 contains the gas (e.g. nitrogen). Apart from pressure forces exerted by the hydraulic liquid and the gas, auxiliary piston 242 is freely movable in auxiliary reservoir 240, so that the pressure in the first and second part will be equalized. In some embodiments auxiliary piston 242 may be omitted, e.g. when is ensured that the space occupied by the gas remains above the connection to main cylinder 20.

Because auxiliary reservoir 240 and main cylinder 20 are in fluid communication, the hydraulic pressure in both is equal, and it will be higher than, or equal to the pressure in main reservoir 260. The hydraulic liquid pressures in the hydraulic cylinder and the auxiliary reservoir are equalized. Optionally, one or more valves (not shown) may be located in the fluid connection between auxiliary reservoir 240 and main cylinder 20, but in this embodiment these valves are open during use and do not automatically close under pressures from main cylinder 20 in the pressure range allowed by overpressure protection part 26.

Auxiliary reservoir 240 is a closed reservoir in the sense that it normally keeps the gas and the hydraulic liquid under pressure except for the effects of the connection to main cylinder 20. Like main reservoir 260, auxiliary reservoir 240 has a predetermined pressure characteristic, but the pressure characteristic of auxiliary reservoir 240 differs from that of main reservoir 260, in the sense that the pressure in main reservoir 260 changes less than the pressure in auxiliary reservoir 240 with equal changes of volume of the hydraulic liquid in the respective reservoirs (theoretically when the temperatures are equal, but in practice for any practical temperatures).

As noted the pressure characteristics of the reservoirs are a result of gas pressure variation in the reservoirs 240, 260. A pressure change dP in response to a small volume change dV is $dP=c*dV$, wherein c is a proportionality constant. Under the ideal gas law c is proportional to the mass M of the gas in the reservoir divided by the square of its volume V. Hence the desired different characteristics may be realized with the $M/(V*V)$ for main reservoir 260 is smaller than for auxiliary reservoir 240 at their initial volume absent a force on the mooring cable.

The combination of the amount of gas in auxiliary reservoir 240 and the volume of auxiliary reservoir 240 is selected so that the pressure of the gas is significantly affected by changes of the amount of hydraulic liquid that occur during operation. For example, the combination may be selected at least to double the gas pressure with a full stroke of main piston 22.

In the illustrated embodiment, main cylinder 20 and auxiliary reservoir 240 are coupled directly during use, without valves that function like overpressure valve 262 and one way valve 264, and preferably without intervening valves that open or close automatically dependent on pressure. Thus, auxiliary reservoir 240 does not give rise to a hysteresis like the overpressure protection part.

Figure 3C:
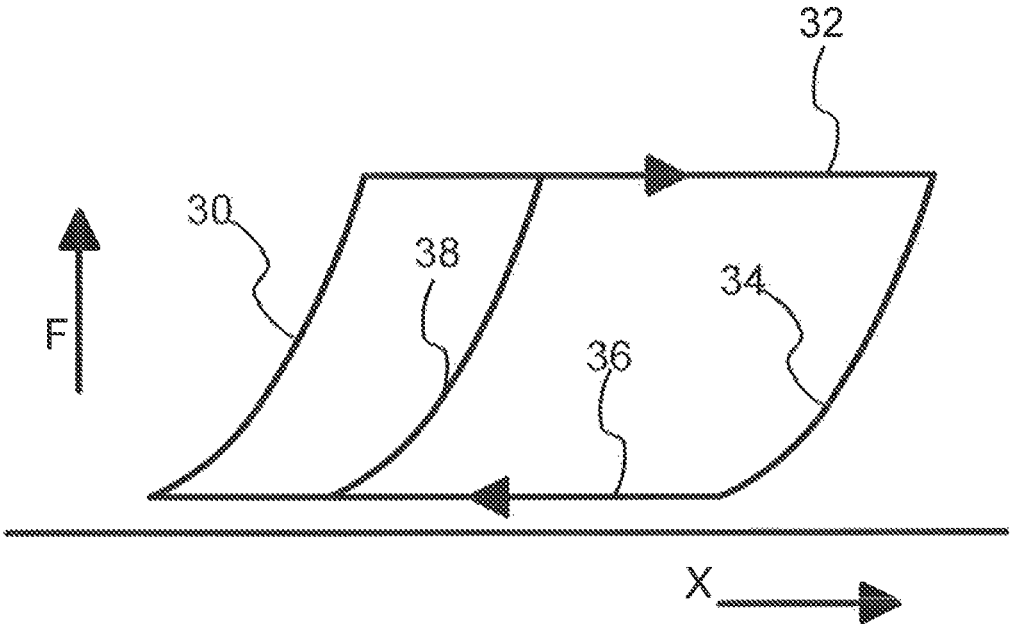

FIG. 3*c* shows an illustration of the force exerted by the cable holding device as a function of position of the main piston. FIG. 3*c* may be compared with FIG. 3*a*. Like FIG. 3*a* it shows first and second levels 32, 36 corresponding to operation in a pay-out and holding phase. Different from FIG. 3*a*, it shows proportional variations 30, 34 in the intermediate phases.

FIG. 3*c* shows a graph of force F and stroke X (position) of the main piston 22 during a force cycle. In the cycle, for example while the ship is raised by swell, a growing force arises. Initially the main piston 22 moves in a first direction as a result of this force while producing an increasing reaction force determined by compression of the gas by auxiliary piston 242 in auxiliary reservoir 240. Due to the effect of auxiliary piston 242, the reaction force increases as a function 30 of displacement of main piston 22 in the first direction.

When the forces reaches a predetermined threshold, overpressure valve 262 opens with the result that main piston 22 moves on at substantially constant reaction force, which results in piston movement at a first force level 32. This may continue until the force drops off or until the piston movement reaches a stop defined e.g. by an inward flange of in main cylinder 20. Although a constant first force level 32 is shown, it should be realized that in fact the force may increase slightly with increase of the pressure of the gas in main reservoir 260 due to compression, but this effect can be kept below a desired size by using a sufficiently large main reservoir 260.

When, later, the force exerted on the mooring cable drops off, overpressure valve 262 closes. Due to the effect of auxiliary piston 242, the force becomes a function 39*b* of displacement of main piston 22 in the first direction that is similar to the function 30 before the force exceeded the threshold, but at shifted positions.

If the force drops to a level corresponding to the pressure associated with opening one way valve 264 (e.g. zero pressure), one way valve 264 allows auxiliary piston 244 to move back at substantially constant (e.g. zero) reaction force. This results in piston movement at a second force level 36, which may in fact vary slightly like first force level 32.

When the force rises from the second force level, auxiliary buffer 24 comes into action to produce a force as a function 38 of displacement of main piston 22 in the first direction, similar to the function 30 before the force exceeded the threshold, but at shifted positions. It may be noted that in the resulting cycle, the pressure in main reservoir 260 remains substantially constant, whereas the pressure in auxiliary reservoir 240 rises and falls with the force.

When a ship is moored with first and second cable holding devices coupled to the ship so that that the first and second cable holding devices operate in opposite directions, for example because the first and second cable holding devices are coupled to opposite ends of the ship, both the first and second cable holding devices may be of the type shown in FIG. 4.

Figure 3D:
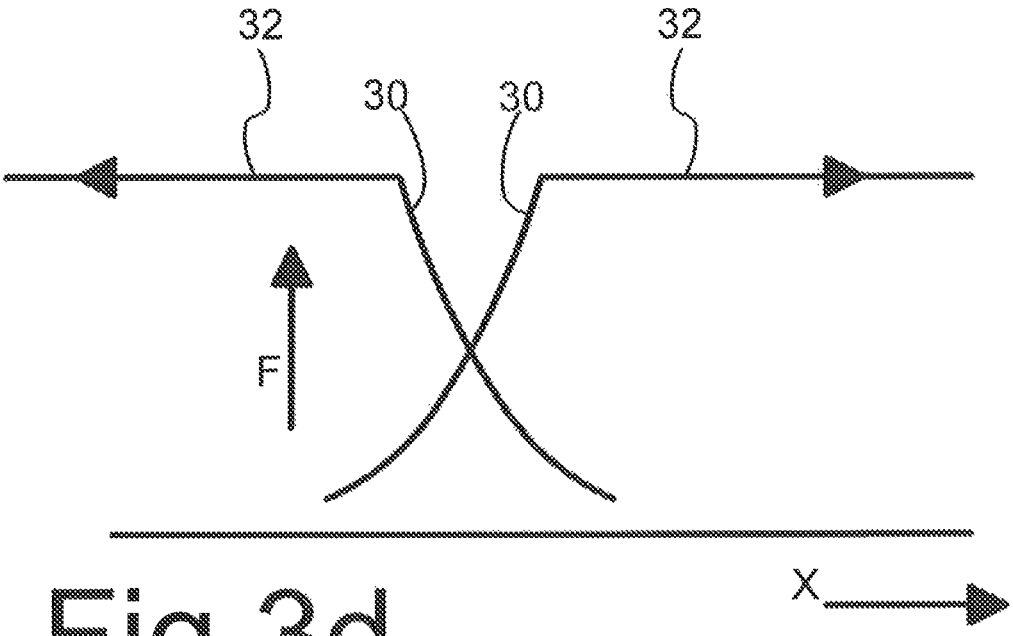

FIG. 3*d* shows graphs of forces as a function of position of a ship, where the forces are forces exerted by two cable holding devices, when the two cable holding devices act in opposite direction of the same ship. In this case the plotted forces act in opposite directions. The position of the ship may position along the quay in the case of movement of the ship along the quay, or rotation angle if the ship rotates slightly around a vertical axis in the plane of the quayside.

When external forces arise, the ship's position may change. In principle the resulting position of the ship correspond to a position where one of the curves cross after one of the curves has been shifted vertically relative to the other by the net amount of external force. This leads to a less variable position of the ship than in the example illustrated with FIG. 3*b*.

If external force on the ship causes the ship to move and eventually causes one of the cable holding devices to enter the hauling phase, the other cable holding device will exert an increasing force on its mooring cable, counteracting the ships movement.

Embodiment with Pressure Boost

Figure 5:
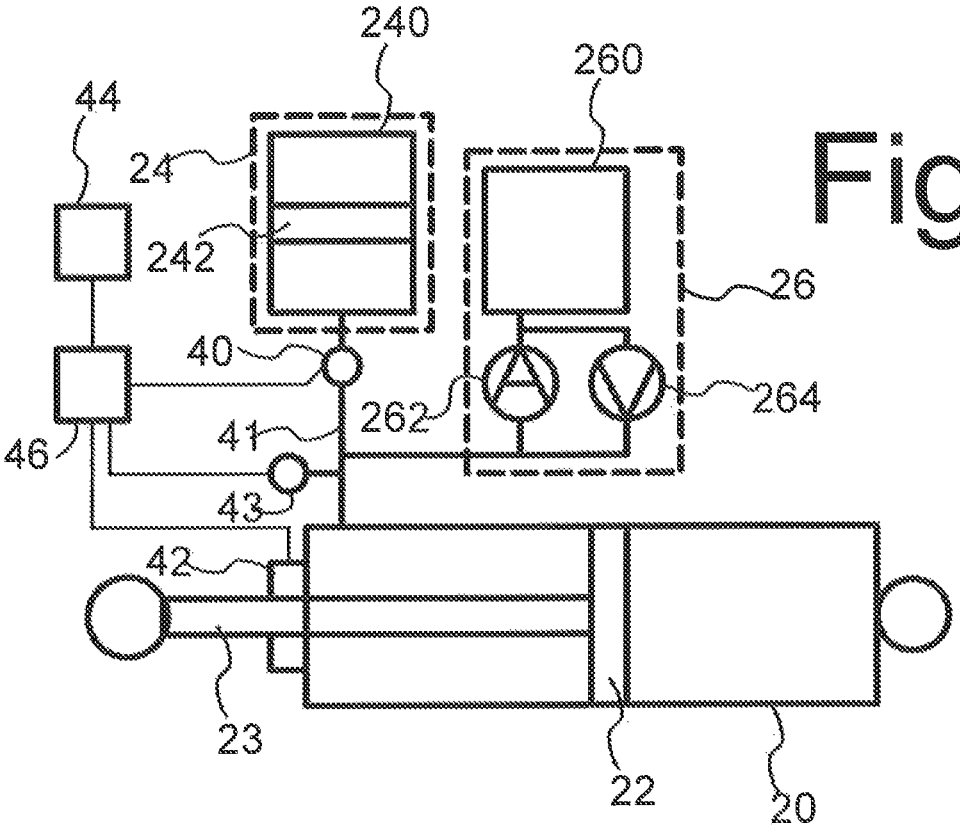

FIG. 5 shows an embodiment of the cable holding device that provides for more concerted action of a plurality of cable holding devices. The same reference numerals as in FIG. 2 indicate the same components. An electronically controllable auxiliary valve 40 has been added in the hydraulic liquid channel 41 between main cylinder 20 and auxiliary reservoir 240 of auxiliary buffer 24. Furthermore, the cable holding device comprises a control unit 46 coupled to a control input of auxiliary valve 40. By way of example, the cable holding device is shown to comprise a sensor 42, control unit 46 being coupled to outputs of sensors 42, 43. Furthermore, control unit 46 comprises an electronic communication device 44 (by way of illustration, electronic communication device 44 is shown connected to control unit 46, but it may be part of the same unit as other components of control unit 46). Electronic communication device 44 may be a wireless transceiver, such as a WIFI transceiver, a UMTS receiver or device for communicating via a wired connection between different cable holding devices.

When a ship is moored with first and second cable holding devices coupled to the ship so that that the first and second cable holding devices operate in opposite directions, for example because the first and second cable holding devices are coupled to opposite ends of the ship, both the first and second cable holding devices may be of the type shown in FIG. 5.

Control unit 46 is configured to control closing off and opening of auxiliary valve 40. The location of auxiliary valve 40 in hydraulic liquid channel 41 means that closing off auxiliary valve 40 has the effect of disconnecting auxiliary buffer 24 from the hydraulic pressure in main cylinder 20. Thus, auxiliary valve 40 is used to provide controllable pressure communication between auxiliary reservoir 240 and the main cylinder. Any location auxiliary valve 40 that provides for such pressure communication may be used.

Control unit 46 is configured to close off auxiliary valve 40 when the pressure in main cylinder 20 is relatively high (e.g. at the level corresponding to the first force level 32), so that this relatively high pressure will be preserved in auxiliary reservoir 240 even when the pressure in main cylinder 20 drops. Control unit 46 is configured to re-open auxiliary valve 40 at a later time, when an external force causes movement of the moored ship in a direction which is counteracted by the cable holding device. Thus, a boosted force is provided at that time, preferably before entering the pay-out phase, which reduces movement.

Figure 3E:
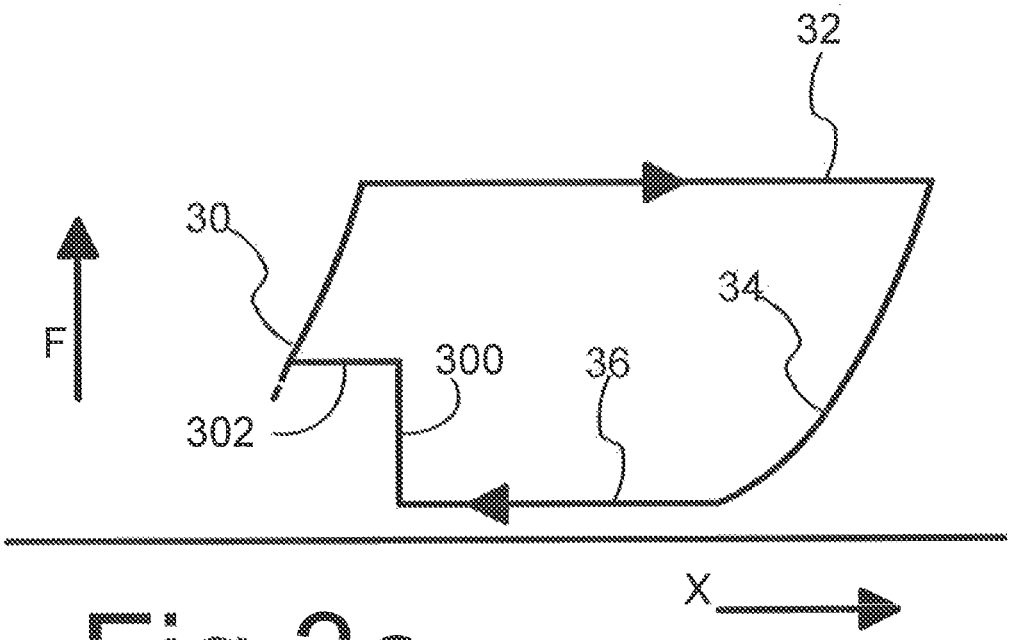

FIG. 3*e* shows an example of such a boosted force. In this example the auxiliary valve 40 is still closed after the hauling phase 36, so that the response to force changes results in little or no position change as indicated by part 300 of the response curve. Opening auxiliary valve 40 causes an extra force that results additional hauling as indicated by part 302 of the response curve, after which the response to force changes becomes similar to that of FIG. 3*c*. With increased force the mooring cable will be paid out, and with reduced force it would be hauled in, as indicated by the dashed line. It should be noted that the illustrated force-position steepness used to show the response part 30 after opening auxiliary valve 40 has been selected for the purpose of illustration only. In practice it may be much steeper for example.

Control unit 46 may be configured to use any of a number of ways to trigger closing of auxiliary valve 40. By way of example, control unit 46 my use a pressure sensor 43 coupled to main cylinder 20, or to auxiliary reservoir 240, or to hydraulic liquid channel 41 to detect when the pressure exceeds a threshold and t trigger closing when the threshold is exceeded. Alternatively, a mechanical trip device that may be considered part of control unit 46 may be used that closes auxiliary valve 40 when the pressure exceeds the threshold. As another alternative, control unit 46 may be coupled to a position sensor 32 configured to measure the position of main piston and control unit 46 may be configured to control closing of auxiliary valve 40 dependent on the measured position Similarly, any of a number of ways of detecting movement of the ship in order to trigger re-opening of auxiliary valve 40 may be used. In an embodiment, control unit 46 may be configured to receive information via communication device 44 and to control re-opening based on that information. Control unit 46 may be configured to read piston position and/or movement sensing information from sensor 42 and transmit derived information via communication device 44 to the control unit of another cable holding device for enabling that control unit to control re-opening.

For example, if the sensing information indicates that the piston is moving in a direction and at a speed that indicates that the cable holding device is in the hauling phase, control unit 46 of that cable holding device may transmit derived information indicating this to the cable holding device that is coupled to the opposite end of the ship, and the control unit 46 of the latter cable holding device may use this transmitted information to control reopening of auxiliary valve 40 in the latter cable holding device. In another example, an external sensor for measuring the ship's position or movement may be used to transmit the information to the control unit 46 to control reopening of auxiliary valve 40.

It should be noted that if communication fails and/or control unit 46 fails, the device still provides for safe mooring, using overpressure protection part 26, main piston 22 and main cylinder 20. In this case of failure only the function of reducing repeated movement of the stable position is lost.

Control unit 46 may comprise a (programmed or hard-wired) logic circuit that is configured to control unit 46 to make it perform the described function, or a computer with a program memory with a program that serves to configure control unit 46 to do so. This selection may be decided by the control unit 46 of the device wherein the auxiliary valve 40 is closed and opened based on sensor data received from the other cable holding device via electronic communication device 44. But alternatively at least part of these selections may be decided by the control unit of the other cable holding device, or by a central control unit outside both devices, and communicated by commands to open and/or close. In both of the latter cases it may suffice that control unit 46 is able to execute commands received from electronic communication device 44 to close and/or open auxiliary valve 40.

Threshold Embodiments of the Auxiliary Buffer

Figure 6:
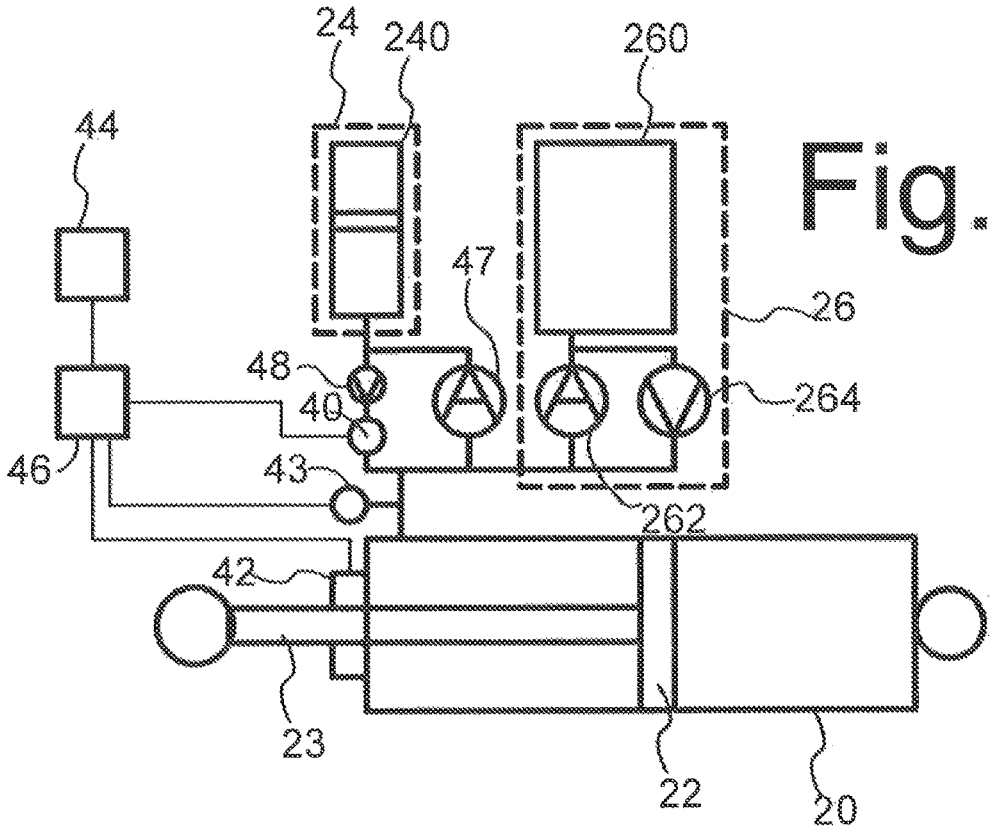

FIG. 6 shows another embodiment of the cable holding device wherein auxiliary reservoir 240 and main cylinder 20 are coupled by a second one way valve 47 and a second overpressure valve 48 in parallel as in overpressure protection part 26. Auxiliary reservoir 240 has a pressure characteristic that differs from the pressure characteristic of main reservoir 260, in the sense that the pressure in main reservoir 260 changes less than the pressure in auxiliary reservoir 240 with equal changes of volume of the hydraulic liquid in the respective reservoirs. Preferably, auxiliary reservoir 240 has a smaller volume than main reservoir 260. In an embodiment, second overpressure valve 48 may be set to open at an overpressure that is lower than the overpressure at which overpressure valve 262 of overpressure protection part 26 is set to open.

Basically, auxiliary reservoir 240 and main reservoir 260 of this embodiment act in a similar way, except that the pressure in auxiliary reservoir 240 rises more strongly than in main reservoir 260 in response to inflow of hydraulic liquid.

Figure 3F:
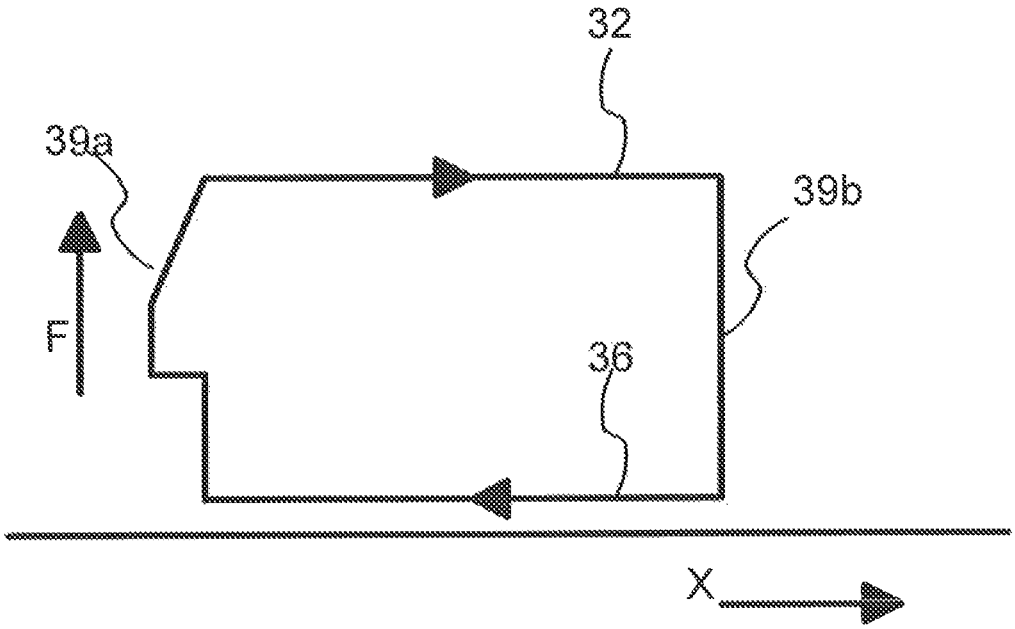

The resulting force position diagram is shown in FIG. 3*f*. A proportional phase 39*a* is added, which starts at a force level above that corresponding to the overpressure of second overpressure valve 48 and ends at the first force level 32 defined by the main reservoir. In the proportional phase 39*a* the force increases in proportion to position change. This leads to a less variable position of the ship. The force-position steepness shown in FIG. 3*f* is selected for the purpose of illustration rather than as a representative steepness.

Optionally, as shown in FIG. 6, a control unit, one or more sensors and an electronically controlled auxiliary valve 40 may be provided in a similar way as in the embodiment of FIG. 5, the auxiliary valve 40 being connected in series with second one way valve 47. This makes it possible to preserve the built-up extra pressure in auxiliary reservoir 240 when the force drops to second force level 36 and to use this extra pressure for a pressure boost before entering the pay-out phase, as in the embodiment of FIG. 5, which reduces movement. Compared to FIG. 5, use of second overpressure valve 48 for filling auxiliary reservoir 240 has the effect that a stiffer force-position response may be provided when the cable holding device is in the intermediate phase.

It should be noted that if communication fails and/or control unit 46 fails, the device still provides for safe mooring, using overpressure protection part 26, main piston 22 and main cylinder 20. In this case of failure only the function of reducing repeated movement of the stable position is lost. One way valve 47 may be omitted, because its function may be realized by auxiliary valve 40, optionally under control of control unit 46. If auxiliary valve 40 remains closed or open, the cable holding device operates essentially like a device without auxiliary buffer or like the device of FIG. 4. One way valve 47 serves to prevent the latter if control unit 46 fails, ensuring a well defined fail save mode.

In another embodiment, auxiliary valve 40 may be coupled in series with return valve 264. A comparable pressure force characteristic may be achieved in this way. In this embodiment the auxiliary reservoir could be omitted when the pressure-volume response characteristic of the auxiliary reservoir is not used. However, use of the auxiliary reservoir has the advantage that the operation of the main reservoir is not affected.

Electric Power Generation

Figure 7:
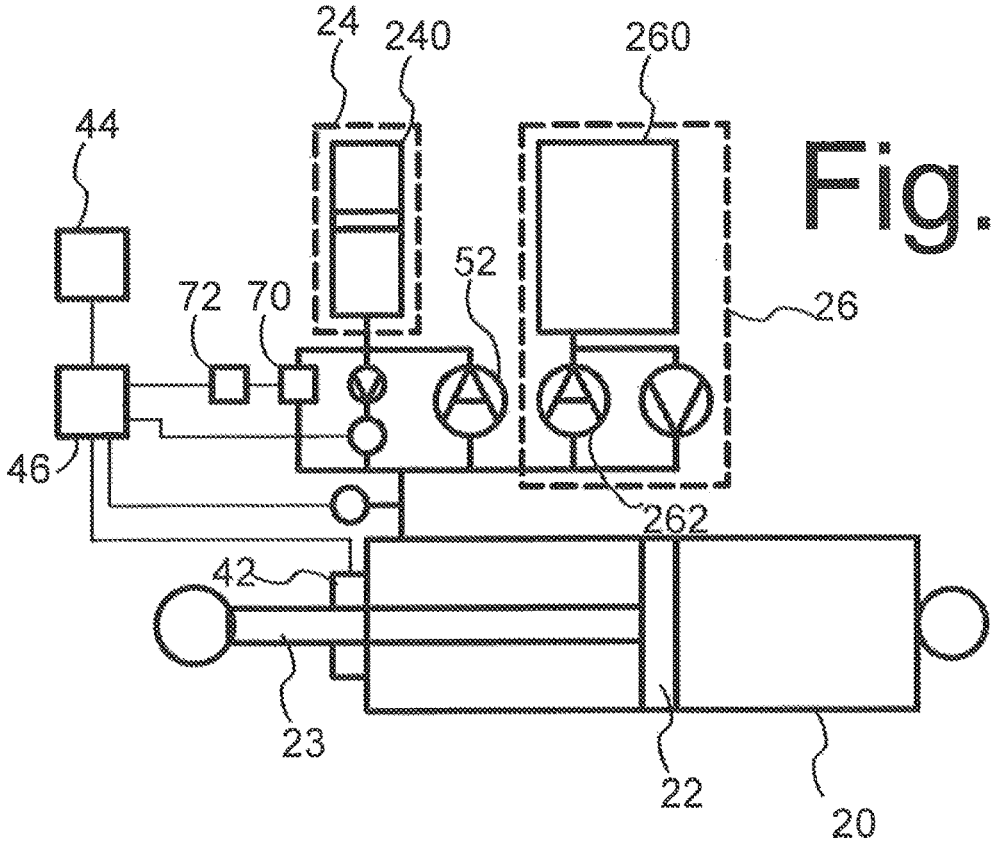

FIG. 7 shows an embodiment wherein the auxiliary buffer is used to generate electric power, which may be used to power control unit 46 and communication device 44. For this purpose a fluid driven electrical generator 70, a storage battery circuit 72 and a hydraulic fluid flow channel is provided between auxiliary reservoir 240 and main cylinder 20, in parallel with second overpressure valve 47, the hydraulic fluid flow channel comprising fluid driven electrical generator 70. The fluid flow channel serves as a leakage bypass in parallel with the fluid flow channels containing the valves. An output of fluid driven electrical generator 70 is coupled to storage battery circuit 72. Storage battery circuit 72 comprises a chargeable battery and it may comprise a conventional storage control circuit and/or output voltage control circuit (not shown). An output of storage battery circuit 72 is coupled to a power input of control unit 46. Fluid driven electrical generator 70 may comprise a fluid current limiter, or a fluid current limiter may be placed in series with it, so that auxiliary reservoir 240 will only slowly lose pressure due to hydraulic liquid flow through fluid driven electrical generator 70.

In operation, when the hydraulic liquid in auxiliary reservoir 240 is at a higher pressure than the fluid in main cylinder 20, the pressure difference drives fluid driven electrical generator 70 to generate electric power, which is stored in storage battery circuit 72. The leakage current slightly decreases the area of the force position loop through which the cable holding device cycles (cf. FIG. 3*a*), and which represents energy generated by movement of the ship and absorbed by the hydraulic liquid.

Figure 8:
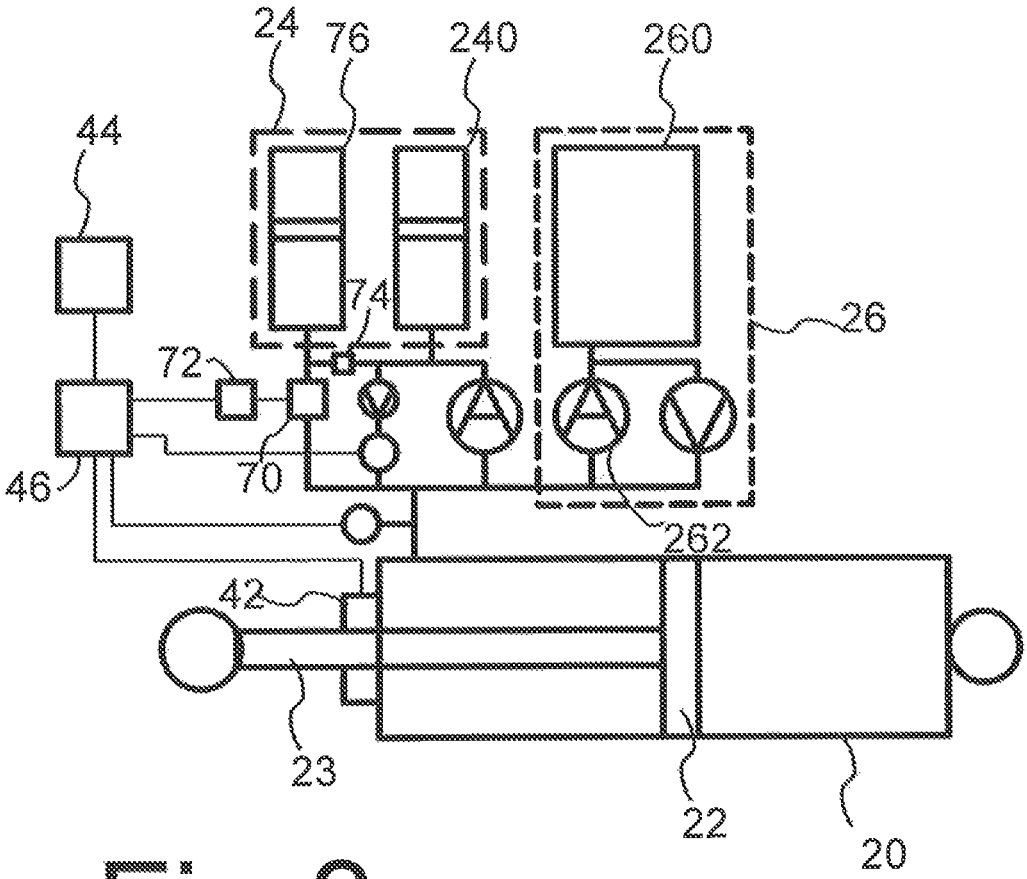

FIG. 8 shows an embodiment wherein a one way valve 74 and a further auxiliary reservoir 76 distinct from auxiliary reservoir 240 are added. Further auxiliary reservoir 76 is used for generating power. Auxiliary reservoir 240 is connected as in the embodiment of FIG. 6. One way valve 74 is coupled between auxiliary reservoir 240 and further auxiliary reservoir 76. Fluid driven electrical generator 70 is coupled between further auxiliary reservoir 76 and main cylinder 20. One way valve 74 is configured to pass hydraulic liquid from auxiliary reservoir 240 and further auxiliary reservoir 76 when the hydraulic liquid pressure in the latter is lower than in the former. In this way it may be ensured that fluid under sufficient pressure for the pressure boost is always available from auxiliary reservoir 240.

It should be noted that a construction with a further auxiliary reservoir 76 and a fluid driven electrical generator 70 in combination with a valve that allows hydraulic liquid pressure to build up with hydraulic liquid from main cylinder 20, but not released except through fluid driven electrical generator 70 may be used in any of the described embodiments. In other embodiments, one or more of the reservoirs that are already present for other purposes may be used instead of further auxiliary reservoir 76 for power generation. In embodiments, the hydraulic liquid flow from main cylinder 20 to auxiliary reservoir 240 may be used to drive an electric power generator. As noted, in some embodiments the auxiliary reservoir could be omitted when the pressure-volume response characteristic of the auxiliary reservoir is not used, the additional elements that are coupled to the auxiliary reservoir 240 being coupled to the main reservoir 260 instead. Use of the auxiliary reservoir has the advantage that operation of the main reservoir is not affected.

Although a number of valves are shown in the embodiments of the cable holding device, it should be noted that more valves may be present in the cable holding device. For example manually operable valves may be present to shut off or open selectable parts of the hydraulic circuit, or additional one way valves to prevent the possibility of current flows that do not contribute to the desired operation. Although all components of the hydraulic liquid circuit are shown to be connected to the main cylinder via a single connection, it should be noted that they may be connected via different connections. Further control actuators may be present, such as overpressure adjustment actuators to enable the control unit to control the overpressure thresholds at which one of more of the overpressure valves open. Similarly, further pressure sensors may be present, e.g. to monitor the pressures in the different hydraulic liquid reservoirs. The function of a number of the valves may be implemented using control by the control unit, dependent on sensor input.

Although embodiments have been shown wherein the pulling force of the mooring cable acts to pull out the main piston from the main cylinder against the pressure defined by the hydraulic circuit, it should be noted that instead a transmission mechanism may be used to convert the pulling force from the mooring cable to a force that acts to push in the main piston into the main cylinder, against the pressure defined by the hydraulic circuit. In this case the hydraulic circuit should be connected to the other end of the main cylinder than that shown in the figures.

The invention claimed is:

1. A hydraulic mooring cable holding device, comprising a hydraulic cylinder, a piston in said hydraulic cylinder, and connections to said hydraulic cylinder and said piston for connecting the device in a mooring cable connection between a ship and a mooring point, an overpressure protection part coupled to the hydraulic cylinder, the overpressure protection part comprising a main reservoir containing gas and hydraulic liquid, the overpressure protection part comprising an overpressure valve and a one way valve, coupled in parallel to each other between the hydraulic cylinder and the main reservoir, the overpressure valve configured to pass hydraulic liquid from the hydraulic cylinder to the main reservoir when a difference between a first pressure in the cylinder and a second pressure in the main reservoir exceeds a first threshold value, the one way valve configured to pass hydraulic liquid from the main reservoir to the hydraulic cylinder when the difference drops below a second threshold value, lower than the first threshold value;

an auxiliary reservoir coupled to the hydraulic cylinder, the auxiliary reservoir containing gas and hydraulic liquid, the main reservoir having a first pressure-volume change characteristic that differs from a second pressure-volume change characteristic of the auxiliary reservoir, in the sense that the pressure in main reservoir changes less than the pressure in auxiliary reservoir for equal exchanges of volume of the hydraulic liquid from the hydraulic cylinder;

a controllable valve coupled between the auxiliary reservoir and the hydraulic cylinder and configured, when opened, to allow hydraulic pressure communication between the auxiliary reservoir to the hydraulic cylinder and, when closed, to prevent the hydraulic pressure communication; and a control unit, comprising an input for receiving a sensor signal and/or command signals, an output coupled to a control input of the controllable valve, the control unit being configured to control opening and closing of the controllable valve dependent on the sensor signal and/or command signals.

2. A hydraulic mooring cable holding device, comprising a hydraulic cylinder, a piston in said hydraulic cylinder, and connections to said hydraulic cylinder and said piston for connecting the device in a mooring cable connection between a ship and a mooring point, an overpressure protection part coupled to the hydraulic cylinder, the overpressure protection part comprising a main reservoir containing gas and hydraulic liquid, the overpressure protection part comprising an overpressure valve and a one way valve, coupled in parallel to each other between the hydraulic cylinder and the main reservoir, the overpressure valve configured to pass hydraulic liquid from the hydraulic cylinder to the main reservoir when a difference between a first pressure in the cylinder and a second pressure in the main reservoir exceeds a first threshold value, the one way valve configured to pass hydraulic liquid from the main reservoir to the hydraulic cylinder when the difference drops below a second threshold value, lower than the first threshold value;

an auxiliary reservoir coupled to the hydraulic cylinder, the auxiliary reservoir containing gas and hydraulic liquid, the main reservoir having a first pressure-volume change characteristic that differs from a second pressure-volume change characteristic of the auxiliary reservoir, in the sense that the pressure in main reservoir changes less than the pressure in auxiliary reservoir for equal exchanges of volume of the hydraulic liquid from the hydraulic cylinder; and a further overpressure valve coupled between the hydraulic cylinder and the auxiliary reservoir, the further overpressure valve configured to pass hydraulic liquid from the hydraulic cylinder to the auxiliary reservoir when a difference between a first pressure in the main reservoir and a third pressure in the auxiliary reservoir exceeds a third threshold value, the third threshold value lying between the first and second threshold value.

3. A hydraulic mooring cable holding device according to claim 2, comprising a further one way valve coupled between the hydraulic cylinder and the auxiliary reservoir, the further one way valve configured to pass hydraulic liquid from the auxiliary reservoir to the hydraulic cylinder when the difference drops below the second threshold value.

4. A hydraulic mooring cable holding device, comprising a hydraulic cylinder, a piston in said hydraulic cylinder, and connections to said hydraulic cylinder and said piston for connecting the device in a mooring cable connection between a ship and a mooring point, an overpressure protection part coupled to the hydraulic cylinder, the overpressure protection part comprising a main reservoir containing gas and hydraulic liquid, the overpressure protection part comprising an overpressure valve and a one way valve, coupled in parallel to each other between the hydraulic cylinder and the main reservoir, the overpressure valve configured to pass hydraulic liquid from the hydraulic cylinder to the main reservoir when a difference between a first pressure in the cylinder and a second pressure in the main reservoir exceeds a first threshold value, the one way valve configured to pass hydraulic liquid from the main reservoir to the hydraulic cylinder when the difference drops below a second threshold value, lower than the first threshold value;

an auxiliary reservoir coupled to the hydraulic cylinder, the auxiliary reservoir containing gas and hydraulic liquid, the main reservoir having a first pressure-volume change characteristic that differs from a second pressure-volume change characteristic of the auxiliary reservoir, in the sense that the pressure in main reservoir changes less than the pressure in auxiliary reservoir for equal exchanges of volume of the hydraulic liquid from the hydraulic cylinder; and a fluid connection between the auxiliary reservoir and the hydraulic cylinder, configured to equalize the hydraulic liquid pressures in the hydraulic cylinder and the auxiliary reservoir at least at all pressures at which the overpressure valve remains closed.

5. A hydraulic mooring cable holding device, comprising a hydraulic cylinder, a piston in said hydraulic cylinder, and connections to said hydraulic cylinder and said piston for connecting the device in a mooring cable connection between a ship and a mooring point, an overpressure protection part coupled to the hydraulic cylinder, the overpressure protection part comprising a main reservoir containing gas and hydraulic liquid, the overpressure protection part comprising an overpressure valve and a one way valve, coupled in parallel to each other between the hydraulic cylinder and the main reservoir, the overpressure valve configured to pass hydraulic liquid from the hydraulic cylinder to the main reservoir when a difference between a first pressure in the cylinder and a second pressure in the main reservoir exceeds a first threshold value, the one way valve configured to pass hydraulic liquid from the main reservoir to the hydraulic cylinder when the difference drops below a second threshold value, lower than the first threshold value;

an auxiliary reservoir coupled to the hydraulic cylinder, the auxiliary reservoir containing gas and hydraulic liquid, the main reservoir having a first pressure-volume change characteristic that differs from a second pressure-volume change characteristic of the auxiliary reservoir, in the sense that the pressure in main reservoir changes less than the pressure in auxiliary reservoir for equal exchanges of volume of the hydraulic liquid from the hydraulic cylinder; and a fluid flow channel between the hydraulic cylinder and the auxiliary reservoir and a fluid flow driven electrical power generator connected to the fluid flow channel.

6. A hydraulic mooring cable holding device according to claim 1, wherein the control unit comprises a communication device for receiving information and/or commands from a further hydraulic mooring cable holding device or a central unit, and wherein the control unit is configured to control opening of the controllable valve dependent on the information and/or commands.

7. A hydraulic mooring cable holding device according to claim 6, comprising a position and/or movement sensor configured to measure a position and/or movement of the piston relative to the hydraulic cylinder, wherein the control unit being configured to transmit information or a command derived from the position and/or movement sensor via the communication device to the further hydraulic mooring cable holding device or the central unit, for use to control the further hydraulic mooring cable holding device.

8. A hydraulic mooring system comprising at least two hydraulic mooring cable holding devices, located on a quayside to exert pulling forces with opposite direction components along the direction of the quayside on mooring cables connected to a same ship, wherein each of said at least two hydraulic mooring cable holding devices comprises a hydraulic cylinder, a piston in said hydraulic cylinder, and connections to said hydraulic cylinder and said piston for connecting the device in a mooring cable connection between a ship and a mooring point, an overpressure protection part coupled to the hydraulic cylinder, the overpressure protection part comprising a main reservoir containing gas and hydraulic liquid, the overpressure protection part comprising an overpressure valve and a one way valve, coupled in parallel to each other between the hydraulic cylinder and the main reservoir, the overpressure valve configured to pass hydraulic liquid from the hydraulic cylinder to the main reservoir when a difference between a first pressure in the cylinder and a second pressure in the main reservoir exceeds a first threshold value, the one way valve configured to pass hydraulic liquid from the main reservoir to the hydraulic cylinder when the difference drops below a second threshold value, lower than the first threshold value, an auxiliary reservoir coupled to the hydraulic cylinder, the auxiliary reservoir containing gas and hydraulic liquid, the main reservoir having a first pressure-volume change characteristic that differs from a second pressure-volume change characteristic of the auxiliary reservoir, in the sense that the pressure in main reservoir changes less than the pressure in auxiliary reservoir for equal exchanges of volume of the hydraulic liquid from the hydraulic cylinder.

9. A method of holding a moored ship, using a first and second cable holding device, each comprising a hydraulic cylinder and a piston in the hydraulic cylinder, a main reservoir and an auxiliary reservoir containing hydraulic liquid and gas, the method comprising coupling a first and second mooring cable from the ship to a quayside, via the piston and hydraulic cylinder of the first and second hydraulic mooring cable holding device respectively, the first and second mooring cable exerting forces on the ship with opposite direction components along the direction of the quayside;

releasing hydraulic fluid from the hydraulic cylinder to the main reservoir in the first and second cable holding device respectively, when a force on the first or second mooring cable exceeds a first threshold respectively;

returning hydraulic liquid from the main reservoir to the hydraulic cylinder in the first and second cable holding device respectively, when a hydraulic pressure in the main reservoir is more than a second threshold below a threshold in the first and second cable holding device respectively, providing hydraulic pressure communication fluid between the hydraulic cylinder to the auxiliary reservoir in the first and second cable holding device respectively, during a phase wherein no hydraulic fluid is released from or returned to the hydraulic cylinder by the main reservoir in the first and second cable holding device respectively.

10. A method according to claim 9, wherein the hydraulic pressure communication is selectively activated in the first and second cable holding device respectively in response to detection that the second and first cable holding device hauls in the second or first mooring cable.

11. A method according to claim 9, wherein the hydraulic fluid is transferred from the hydraulic cylinder to the auxiliary reservoir in the first and second cable holding device when the hydraulic fluid pressure in the hydraulic cylinder exceeds a pressure in the auxiliary reservoir by a third threshold.

12. A method according to claim 9, comprising driving an electrical power generator by a hydraulic liquid pressure difference between the auxiliary reservoir and the hydraulic cylinder in the first and second cable holding device.

* * * * *